US008992162B2

(12) United States Patent
Henry et al.

(10) Patent No.: US 8,992,162 B2
(45) Date of Patent: Mar. 31, 2015

(54) MULTI-INLET VACUUM PUMP

(75) Inventors: Markus Henry, Cologne (DE); Heinz Englaender, Linnich (DE); Christian Beyer, Cologne (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 863 days.

(21) Appl. No.: 13/257,002

(22) PCT Filed: Mar. 3, 2010

(86) PCT No.: PCT/EP2010/052698

§ 371 (c)(1),
(2), (4) Date: Dec. 29, 2011

(87) PCT Pub. No.: WO2010/105908

PCT Pub. Date: Sep. 23, 2010

(65) Prior Publication Data

US 2012/0087776 A1 Apr. 12, 2012

(30) Foreign Application Priority Data

Mar. 19, 2009 (DE) ..... 20 2009 003 880 U

(51) Int. Cl.
*F04D 19/04* (2006.01)
*F04D 29/38* (2006.01)
*F04D 29/52* (2006.01)

(52) U.S. Cl.
CPC ..... *F04D 19/042* (2013.01); *F04D 29/522* (2013.01); *F05B 2250/501* (2013.01)
USPC ..... 415/90; 415/199.1; 415/207; 416/201 A

(58) Field of Classification Search
CPC ..... F04D 19/02; F04D 19/028; F04D 19/04; F04D 19/042; F04D 19/046; F04D 29/384; F04D 29/522
USPC ..... 415/55.1, 55.5, 55.6, 60, 62, 65, 66, 67, 415/90, 199.1, 199.4, 199.5, 198.1, 207; 416/175, 198 R, 198 A, 201 R, 201 A
See application file for complete search history.

(56) References Cited

U.S. PATENT DOCUMENTS 1,508,006 A 9/1924 Bowen
4,668,160 A 5/1987 Mase et al.
(Continued)

FOREIGN PATENT DOCUMENTS

DE 19821634 A1 11/1999
DE 202005019644 U1 5/2007
(Continued)

*Primary Examiner* — Edward Look
*Assistant Examiner* — Jason Davis
(74) *Attorney, Agent, or Firm* — Fay Sharpe LLP

(57) ABSTRACT

A multi-inlet vacuum pump has a first pump device (10) and a second pump device (12). The first pump device (10) includes a first rotor element (18) having a plurality of first rotor discs (20, 21) arranged consecutively in the delivery direction (36). The second rotor disc includes a second rotor element (26) having a plurality of second rotor discs (28) arranged consecutively in the delivery direction (36). A first fluid flow (34) is suctioned through a main inlet (32) by the first pump device (10) and delivered in the direction of the second pump device (12). A second fluid flow (40) is suctioned through an intermediate inlet (38) by the second pump device and delivered in the direction of a pump outlet. The diameter of the last rotor disc (21) of the first pump (10) substantially corresponds to the diameter of the first rotor (28) of the second pump device (12).

11 Claims, 1 Drawing Sheet

(56) References Cited

U.S. PATENT DOCUMENTS

| | | | | |
|---|---|---|---|---|
| 5,211,179 | A | 5/1993 | Haberl et al. | |
| 5,219,269 | A | 6/1993 | Ikegami et al. | |
| 6,371,735 | B1 | 4/2002 | Goodwin et al. | |
| 6,435,811 | B1 | 8/2002 | Beyer et al. | |
| 6,503,050 | B2 * | 1/2003 | Reimer et al. | 415/90 |
| 2003/0086784 | A1 | 5/2003 | Stuart | |
| 2003/0223859 | A1 | 12/2003 | Carboneri et al. | |
| 2008/0193303 | A1 | 8/2008 | Stones | |
| 2011/0135506 | A1 | 6/2011 | Henry et al. | |

FOREIGN PATENT DOCUMENTS

| | | | |
|---|---|---|---|
| EP | 1085214 | A2 | 3/2001 |
| EP | 1249613 | A1 | 10/2002 |
| EP | 1302667 | A1 | 4/2003 |
| WO | 2006048602 | A2 | 5/2006 |

* cited by examiner

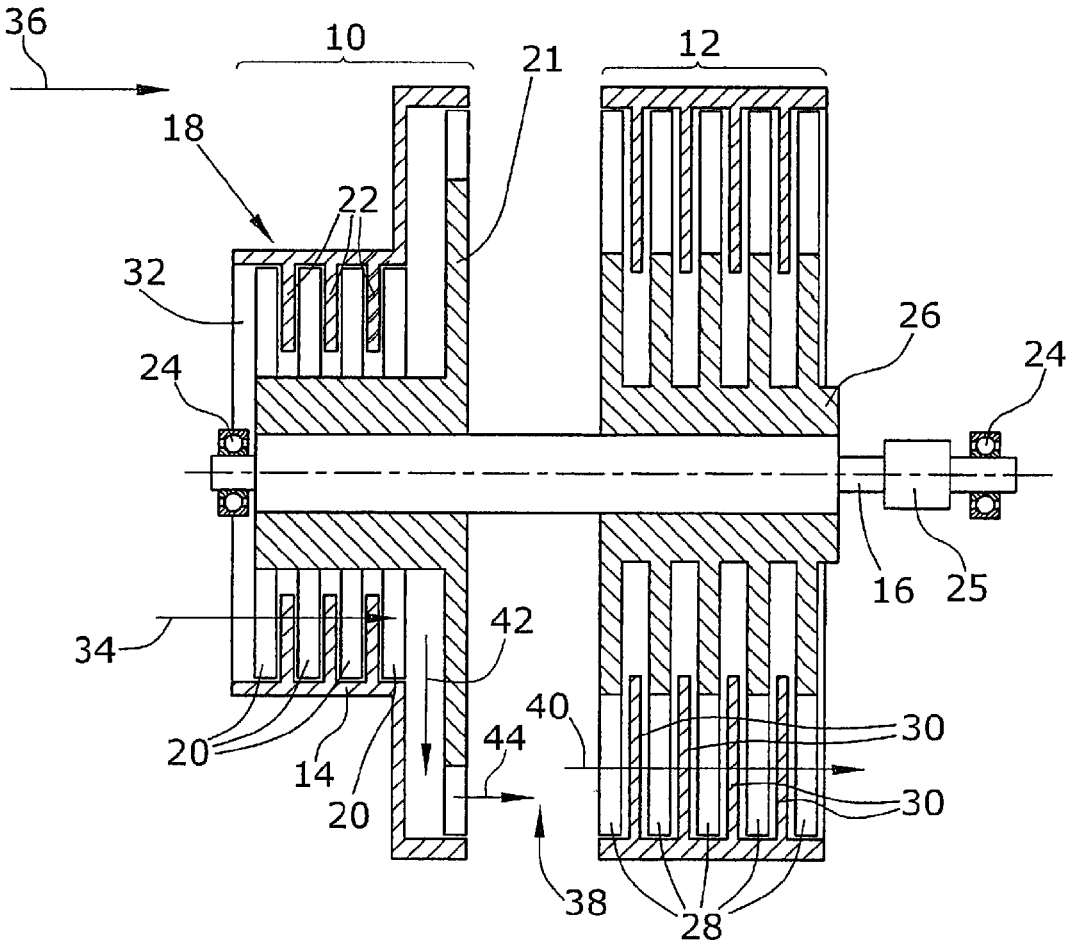
36
10
21
12
18
22
32
26
24
24
16
25
34
42
40
30
20
44
30
14
20
38
28

MULTI-INLET VACUUM PUMP

BACKGROUND

The present invention relates to a multi-inlet vacuum pump.

Multi-inlet vacuum pumps comprise, within a common housing, a plurality of pump devices provided e.g. as turbomolecular pumps, optionally in connection with a Holweck stage. Usually, the individual pump devices are carried by a common rotor shaft and are driven by a single electric motor. The pump housing comprises a main inlet through which a first fluid stream is sucked in by operation of the first pump device. Then, after passing through the first pump device, the first fluid stream will be conveyed in the direction of an outlet by the second pump device and, optionally, by further pump devices. Between the first and second pump devices, an intermediate inlet is provided for suctional intake of a second fluid stream by operation of the second pump device. The second pump device will thus convey the first and second fluid streams in the direction of the outlet. Optionally, a second intermediate inlet can be provided between the second pump device and a third pump device. By operation of the third pump device, also a corresponding third fluid stream is conveyed in the direction of the outlet, wherein all of said three fluid streams will be conveyed by the third pump device.

It is an object of the invention to provide a multi-inlet vacuum pump having a high suction capacity in said intermediate inlet.

SUMMARY

In a preferred embodiment of the invention, the first pump device comprises a rotor disk, preferably the last rotor disk when viewed in the conveying direction, which has an enlarged diameter. The diameter of the last rotor disk of the first pump device preferably corresponds to the diameter of the first rotor disk of the second pump device, it being particularly preferred that all of the rotor disks of the second pump device have the same diameter. By said enlargement of the diameter of the last rotor disk of the first pump device relative to the other rotor disks of the first pump device, there is effected, still within the first pump device, a radical deflection of the first conveying flow towards the outside. In the region of the intermediate inlet, the first conveying flow will thus already have been deflected. The intermediate inlet is preferably located between said larger-diametered last rotor disk of the first pump device and the first rotor disk of the second pump device. The larger diameter of the last vane of the first rotor stage is effective to improve the compression in the intermediate inlet in the direction towards the outlet and thus to prevent a backflow of the fluids from the intermediate inlet in the direction opposite to the conveying flow. Although this improvement of the compression could also be achieved by providing several stages which have the same rotor diameter as the first stage, this solution would be more expensive.

According to the invention, at least one rotor disk of the first rotor element has a diameter which is smaller than the diameter of the second rotor disks of the second rotor element. Thus, according to the invention, the diameter of the rotor disks within the first rotor element is stepped. According to the invention, the first rotor element thus comprises rotor disks with different diameters, wherein also a multiple stepping can be provided within the first rotor element. Preferably, when viewed in the flow direction, at least the first rotor disk of the first rotor element is configured with a smaller diameter than that of the rotor disks of the second rotor element. It is especially preferred that at least 50%, still more preferably at least 75% of the rotor disks of the first rotor element have a smaller diameter than the second rotor disks of the second rotor element.

With preference, it is not only the last rotor disk of the first pump device that has a larger diameter preferably identical to that of the rotor disks of the second pump device. Instead, for instance, it can also be provided that—when seen in flow direction—the last two or even more than the last two rotor disks of the first pump device have a larger diameter than the other rotor disks of the first pump device. Further, it is possible that at least the last two rotor disks of the first pump device have substantially the same diameter as the first rotor disk of the second pump device, while the rotor disks of the second pump device preferably all have the same diameter. Optionally, the diameter of the last rotor disks of the first pump device can increase in a step-wise manner. Thus, starting from the relatively small diameter of the first rotor disk of the first pump device, the diameter of the rotor disks becomes larger with stepped increases, until at least the last rotor disk has a diameter corresponding to the diameter of the rotor disks of the second pump devices.

Optionally, the multi-inlet vacuum pump can also comprise a plurality of intermediate inlets. For this purpose, a further pump device is arranged, when viewed in flow direction, upstream and/or downstream of the first and respectively the second pump device. Between mutually adjacent pump devices, respective intermediate inlets can be provided. It is of relevance for the invention that two mutually adjacent pump devices, which for the sake of brevity will be referred to hereunder as the first and second pump devices, are configured in the above described inventive manner. In a multi-inlet vacuum pump comprising a plurality of intermediate inlets, it is according to the invention also possible that, in the region of an intermediate inlet, the inventive configuration is provided a plurality of times.

BRIEF DESCRIPTION OF THE DRAWINGS

The invention will be described in greater detail hereunder by way of a preferred embodiment with reference to the accompanying drawing.

The FIGURE shows a schematic longitudinal sectional view of a preferred embodiment of the invention.

DETAILED DESCRIPTION

The FIGURE illustrates that part of a multi-inlet vacuum pump which is of relevance for the invention. Said part of the overall pump comprises a first pump device 10 and a further or second pump device 12, both of them arranged in a common housing 14. Additionally, a third pump device such as e.g. a Holweck stage, can be provided in said housing on the right-hand side in the FIGURE.

Said first pump device 10 comprises a rotor element 18 arranged on a rotor shaft 16. In the illustrated embodiment, rotor element 18 comprises four radially extending rotor disks 20 having identical outer diameters as well as one rotor disk 21 having a larger outer diameter. Said rotor disks 20,21 comprise rotor vanes for conveyance of a fluid, particularly gas. Between adjacent rotor disks 20, stationary stator disks 22 are arranged. Said stator disks 22 are fixedly held in housing 14, e.g. with the aid of rings.

On rotor shaft 16, which in the illustrated embodiment is supported by two bearings 24, there is further mounted a further or second rotor element 26 of second pump device 12. In the illustrated embodiment, said second rotor element 26 comprises five rotor disks 28. Between the rotor disks 28, stator disks 30 are arranged which again are fastened in a stationary manner to housing 14, optionally with the aid of stator rings. Also said rotor disks 28 comprise vanes for conveyance of fluid, which vanes are arranged in an outer region which in the FIGURE is shown without hatching.

The first pump device 10 will suck in the gas via a main inlet 32 of housing 14. In this manner, a first fluid flow 34 will be generated in the direction of the second pump device 12, i.e. in the conveying direction 36. The conveying direction 36 corresponds to the main conveying direction from the main inlet 32 towards an outlet which is provided, in the conveying direction, downstream of the last pump device, i.e.—in the FIGURE—on the right-hand side in the housing.

Further, housing 14 is provided with an intermediate inlet 38. Intermediate inlet 38 is arranged in housing 14 between first pump device 10 and second pump device 12. By intermediate inlet 38, a second fluid flow 40 is generated, again in the conveying direction 36. Said second fluid flow 40 is conveyed in the direction of the pump outlet by operation of the second pump device 12 and, optionally, a further pump device arranged downstream thereof. In multi-inlet vacuum pumps related to the exemplary embodiment illustrated herein, a high vacuum exists at the main inlet 32 and a slightly lower vacuum exists at the intermediate inlet 38. To make it possible to obtain the highest possible suction performance, i.e. to generate a low vacuum also on intermediate inlet 38, it is provided in the illustrated embodiment that the radius of the rotor disks 28 of second pump device 12 is larger than the radius of the rotor disks 20 of first pump device 10.

According to the invention, the first pump device 10 comprises an additional rotor disk 21, being the last rotor disk in the conveying direction 36, which has a larger outer diameter than the rotor disks 20. Thereby, the first fluid flow 34, after passing through the first rotor disks 20, will by radially outwardly deflected (arrow 42) by rotor disk 21. In the region of the vanes (non-hatched area) of rotor disk 21, the first fluid flow will pass through rotor disk 21 (arrow 44).

The last rotor disk 21 of first pump device 10 has an outer diameter which substantially corresponds to the outer diameter of rotor disk 28 of second pump device 12. Thus, it is guaranteed, in spite of the different diameters of the rotor disks in relation to the entire multi-inlet vacuum pump, that the first fluid flow 34 and the second fluid flow 40 will be united as desired.

The two rotor elements 18,26 are mounted on a common shaft 16 and are driven by a common electric motor 25.

According to the invention, it is further possible to provide a multi-inlet vacuum pump comprising a plurality of intermediate inlets wherein at least one of said intermediate inlets is configured in the manner described above with reference to the Figure. Preferably, a plurality of intermediate inlets are configured as provided by the invention. Irrespective of the configuration of the individual intermediate inlets, it can also be possible that, with respect to the embodiment shown in the Figure, at least one further pump device is arranged upstream of the first pump device 10 in the flow direction 36. Further at least one further pump device can be provided downstream of the second pump device 12 in the flow direction 36.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A multi-inlet vacuum pump comprising a first pump device comprising a first rotor element with a plurality of first rotor disks serially arranged in the conveying direction, a second pump device comprising a second rotor element with a plurality of second rotor disks serially arranged in the conveying direction, a main inlet through which a first fluid flow is sucked by the first pump device and is conveyed in the direction of the second pump device, and an intermediate inlet through which a second fluid flow is sucked by the second pump device and is conveyed in the direction of a pump outlet, wherein the diameter of at least the last rotor disk of the first pump device substantially corresponds to the diameter of the first rotor disk of the second pump device, the diameter of at least one first rotor disk of the first rotor element being smaller than the diameter of the second rotor disks.

2. The multi-inlet vacuum pump according to claim 1, wherein the diameter of at least the last two rotor disks of the first pump device substantially corresponds to the diameter of the first rotor disk of the second pump device.

3. The multi-inlet vacuum pump according to claim 1, wherein, in the flow direction, the diameter of at least the first rotor disk of the first rotor element is smaller than the diameter of the second rotor disks.

4. The multi-inlet vacuum pump according to claim 1, wherein more than 50% of the rotor disks of the first rotor element have a smaller diameter than the second rotor disks.

5. The multi-inlet vacuum pump according to claim 1, wherein a plurality of the rotor disks of the second pump device have the same diameter.

6. The multi-inlet vacuum pump according to claim 1, wherein the first and second pump devices are adjacent and the intermediate inlet is provided between adjacent pump devices.

7. The multi-inlet vacuum pump according to claim 6, wherein the diameter of the last rotor disk of a pump device arranged farther upstream in the flow direction corresponds to the diameter of the first rotor disk of the pump device arranged downstream thereof in the flow direction.

8. A multi-inlet vacuum pump comprising:

a first pump stage including a first plurality of rotor disks disposed in parallel and coaxially between first stage stator elements, the first plurality of rotor disks including a first stage inlet end rotor disk of a first diameter and a first stage discharge end rotor disk of a second diameter, the first diameter being smaller than the second diameter;

a second pump stage disposed adjacent the first pump stage and defining an intermediate inlet therebetween, the second pump stage including a second plurality of rotor disks disposed in parallel and coaxially with the first plurality of rotor disks and between second stage stator elements, the second plurality of rotor disks including a second stage inlet end rotor disk of the second diameter.

9. The multi-inlet vacuum pump according to claim 8, further including a common drive shaft on which the first and second pluralities of rotor disks are mounted.

10. The multi-inlet vacuum pump according to claim 8, wherein at least half of the first plurality of rotor disks have a first common diameter.

11. The multi-inlet vacuum pump according to claim 10, wherein at least half of the second plurality of rotor disks have a second common diameter larger than the first common diameter.

* * * * *